US005205397A

United States Patent [19]

Sanno

[11] Patent Number: 5,205,397

[45] Date of Patent: Apr. 27, 1993

[54] REMAINED ROVING BOBBIN EXCHANGING DEVICE

[75] Inventor: Hiroaki Sanno, Ishikawa, Japan

[73] Assignee: Kabushiki Kaisha Murao and Company, Kanazawa, Japan

[21] Appl. No.: 867,087

[22] Filed: Apr. 14, 1992

Related U.S. Application Data

[63] Continuation of Ser. No. 654,059, Feb. 12, 1991, abandoned.

[51] Int. Cl.[5] ..... B65G 37/00

[52] U.S. Cl. ..... 198/465.1; 198/465.4; 198/468.8; 57/281; 242/1; 242/35.5 A; 28/295

[58] Field of Search ..... 57/300–306, 57/281, 90, 276; 414/222, 609; 198/465.1, 465.2, 465.4, 468.6, 468.8, 487.1, 803.12; 242/1, 35.5 A; 28/292–295

[56] References Cited

U.S. PATENT DOCUMENTS

| | | | |
|---|---|---|---|
| 4,461,060 | 7/1984 | Mannhart | 28/295 |
| 4,583,358 | 4/1986 | Krieger et al. | 57/281 X |
| 4,598,869 | 7/1986 | Uchida et al. | 57/281 X |
| 4,630,435 | 12/1986 | Igel | 57/281 |
| 4,650,062 | 3/1987 | Uchida | 198/468.6 X |
| 4,723,648 | 2/1988 | Hamatani | 198/465.1 X |
| 4,772,174 | 9/1988 | Küpper | 198/465.2 X |
| 4,776,468 | 10/1988 | Kiriake | 198/803.12 X |
| 4,840,124 | 6/1989 | Tadashima | 198/803.12 X |
| 4,841,719 | 6/1989 | Sasaki et al. | 57/281 |
| 4,842,206 | 6/1989 | Kawasaki et al. | 242/35.5 A |
| 4,899,532 | 2/1990 | Sanno | 57/300 X |
| 4,905,356 | 3/1990 | Nakayama | 28/292 |
| 4,924,999 | 5/1990 | Kikuchi et al. | 198/468.6 X |

FOREIGN PATENT DOCUMENTS

| | | | |
|---|---|---|---|
| 0307806 | 3/1989 | European Pat. Off. . | |
| 0323400 | 7/1989 | European Pat. Off. . | |
| 60-094629 | 5/1985 | Japan . | |
| 63-092735 | 4/1988 | Japan . | |
| 64-6128 | 1/1989 | Japan | 57/281 |

*Primary Examiner*—Daniel P. Stodola
*Assistant Examiner*—Michael R. Mansen
*Attorney, Agent, or Firm*—Oblon, Spivak, McClelland, Maier & Neustadt

[57] ABSTRACT

A remained roving bobbin exchanging device for making all the roving bobbins to be transported to a roving frame into vacant bobbins and discloses the remained roving bobbin exchanging device comprising a fixing or removal device for detecting the bobbins having the remained rovings adhered thereto on the bobbin transporting line and exchanging them with vacant bobbins and a tray transporting device for receiving the remained roving bobbins from the fixing or removal device and supplying the vacant bobbins to the fixing or removal device, in which the tray transporting device is made such that a tray can be circulated and at the same time the remained roving cutter device and the remained roving removal device are arranged to remove the remained roving from the remained roving bobbin.

9 Claims, 12 Drawing Sheets

REMAINED ROVING BOBBIN EXCHANGING DEVICE

This application is a continuation of application Ser. No. 07/654,059, filed on Feb. 12, 1991, now abandoned.

BACKGROUND OF THE INVENTION

1. Field of the Invention

This invention relates to a remained roving bobbin exchanging device for completely removing the remained rovings left and adhered to roving bobbins to be utilized in a spinning frame or a roving frame in a spinning plant and at the same time for preventing the roving bobbins having some residual rovings adhered thereto from being placed in some vacant bobbins.

2. Description of the Prior Art

In order to supply rovings of raw material to a spinning frame, some roving bobbins are utilized and in case of a roving frame, an automatic doffing apparatus is used for replacing plurality of full can roving bobbins with some vacant roving bobbins in the roving frame in all. As a transporting means for the aforesaid roving bobbins, an over-head type transporting means is widely used, some bobbin hangers are arranged on guide rails in every spaced-apart relation, the roving bobbins are hung at the bobbin hangers and then transported. As the bobbin hanger, a system having a structure in which engaging claw pieces are opened or closed in response to an insertion of the roving bobbins or an upward movement of the roving bobbins is applied, in which the roving bobbins may freely be fixed or removed in response to an engagement between some steps at the inner circumferences of the roving bobbins and the aforesaid engagement claw pieces or a releasing of the engagement.

Remained rovings are adhered to almost of all the used roving bobbins replaced at the creel of the roving frame and it is impossible to utilize the roving frame again while the remained rovings being adhered to the bobbins and due to this fact a transporting line for the roving bobbins is provided with a remained roving removal device.

As the remained roving removal device, a system in which the roving bobbins are contacted with and rotated with the felt belts or the like while the roving bobbins being hung at the bobbin hangers so as to remove the remained rovings on the surfaces of the bobbins is utilized and this system is constructed such that the remained rovings are removed at a high speed without damaging the roving bobbins. However, in case that the remained rovings adhered to the roving bobbins are cut in the midway part thereof or the rovings may not be completely removed within a predetermined processing time when a large amount of remained rovings are wound, some of the roving bobbins having the remained rovings left in the roving bobbins passed through the aforesaid remained roving removal device are yet mixed while the remained rovings are being left and adhered, resulting in that an automatic operation for supplying the vacant roving bobbins to the roving frame is prohibited.

Due to this fact, in the prior art, an operator was set at a position before the roving frame, the roving bobbins having the remained rovings adhered are removed from the transporting line and at the same time the already processed and prepared vacant bobbins were fixed.

SUMMARY OF THE INVENTION

In view of the foregoings, it is an object of the present invention to provide a device for automatically exchanging the roving bobbins having the remained rovings with the vacant bobbins in the roving bobbin transporting line before the vacant roving bobbins are supplied to the roving frame.

It is an another object of the present invention to perform a fast removal of the remained rovings in respect to the roving bobbins having the remained rovings removed from the transporting line and to prevent the roving bobbins having the remained rovings adhered thereto from being stayed at one location and then the present invention has been completed.

The present invention accomplished the aforesaid objects is constructed such that there is provided adjacent to the transporting line a fixing or removing device for removing the roving bobbins having the rovings adhered thereto from the transporting line and fixing other vacant bobbins to the transporting line, a tray transporting device for storing the aforesaid roving bobbins and/or vacant bobbins having the remained rovings removed therefrom is arranged below the aforesaid fixing or removal device, a cutter device for cutting the remained rovings on the aforesaid removed roving bobbins in an axial direction of the bobbins and the removing device for removing the cut and remained rovings are arranged adjacent to the aforesaid bobbin circulating storing device.

BRIEF DESCRIPTION OF THE DRAWINGS

FIG. 8(*b*) is an illustration for showing an operation of the fixing or removal device.

DESCRIPTION OF THE PREFERRED EMBODIMENTS

Figure 1:
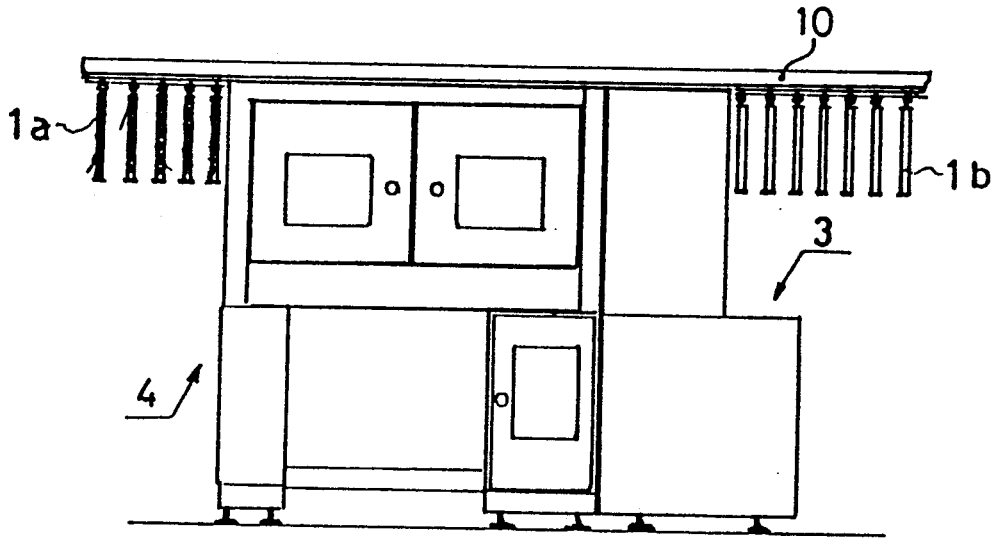
FIG. 1 is a side elevational view for showing an example of application of the device of the present invention.

Referring now to the drawings, the typical preferred embodiments of the present invention will be described.

Figure 2:
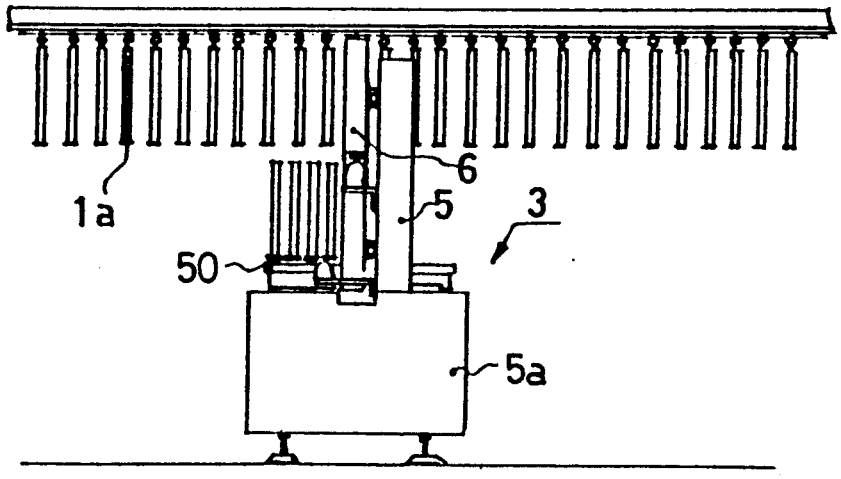
FIG. 2 is a side elevational view for showing the device of the present invention.

As shown in FIG. 1, the remained roving bobbin exchanging device 3 of the present invention is arranged at a downstream side of a remained roving removing device 4 and at an adjoining position or as shown in FIG. 2, it may be arranged in a single form at an appropriate location at the downstream side of the remained roving removal device. An internal structure of the remained roving bobbin exchanging device 3 will be described in detail as follows.

Figure 3:
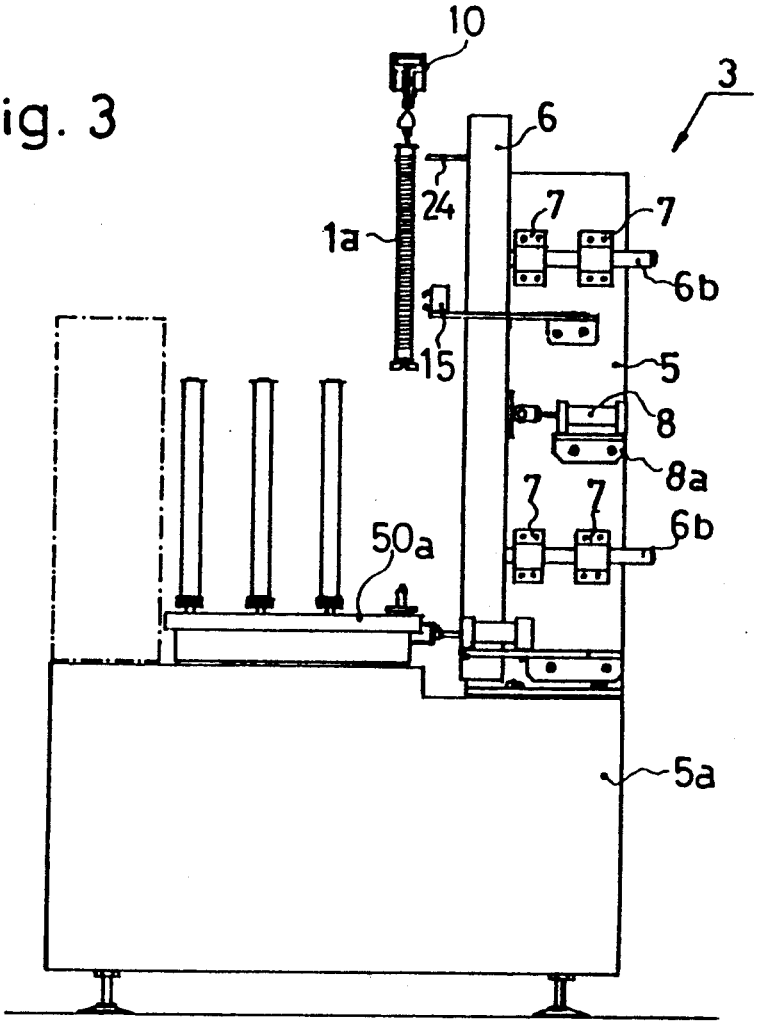
FIG. 3 is a front elevational view for showing an example of the device of the present invention.
Figure 4:
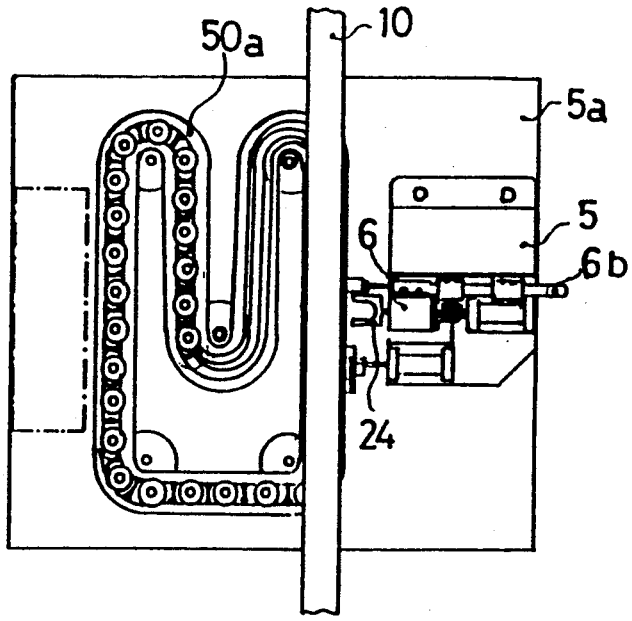
FIG. 4 is a top plan view of FIG. 3.
Figure 5:
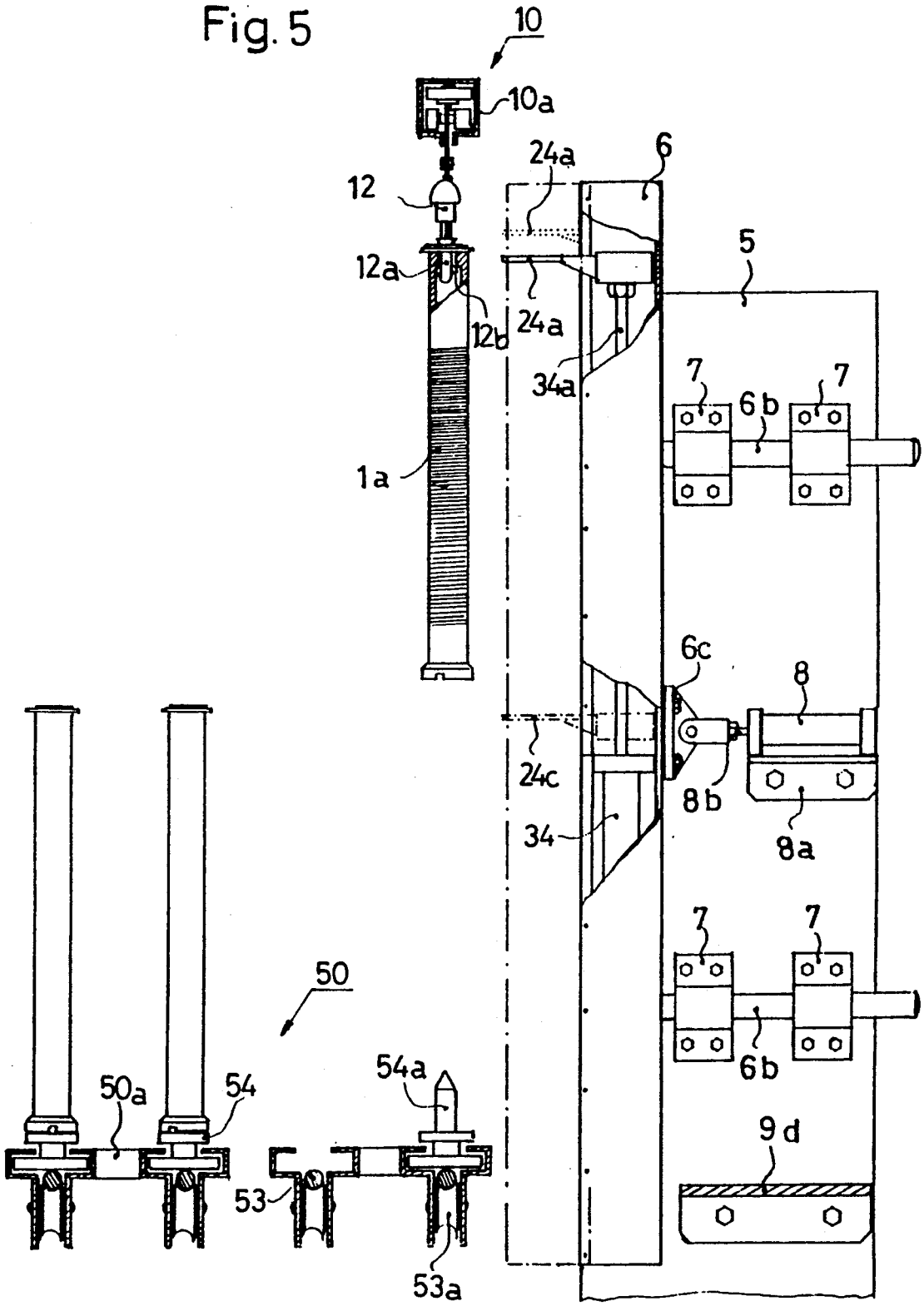
FIG. 5 is a partial enlarged view of FIG. 3.
Figure 6:
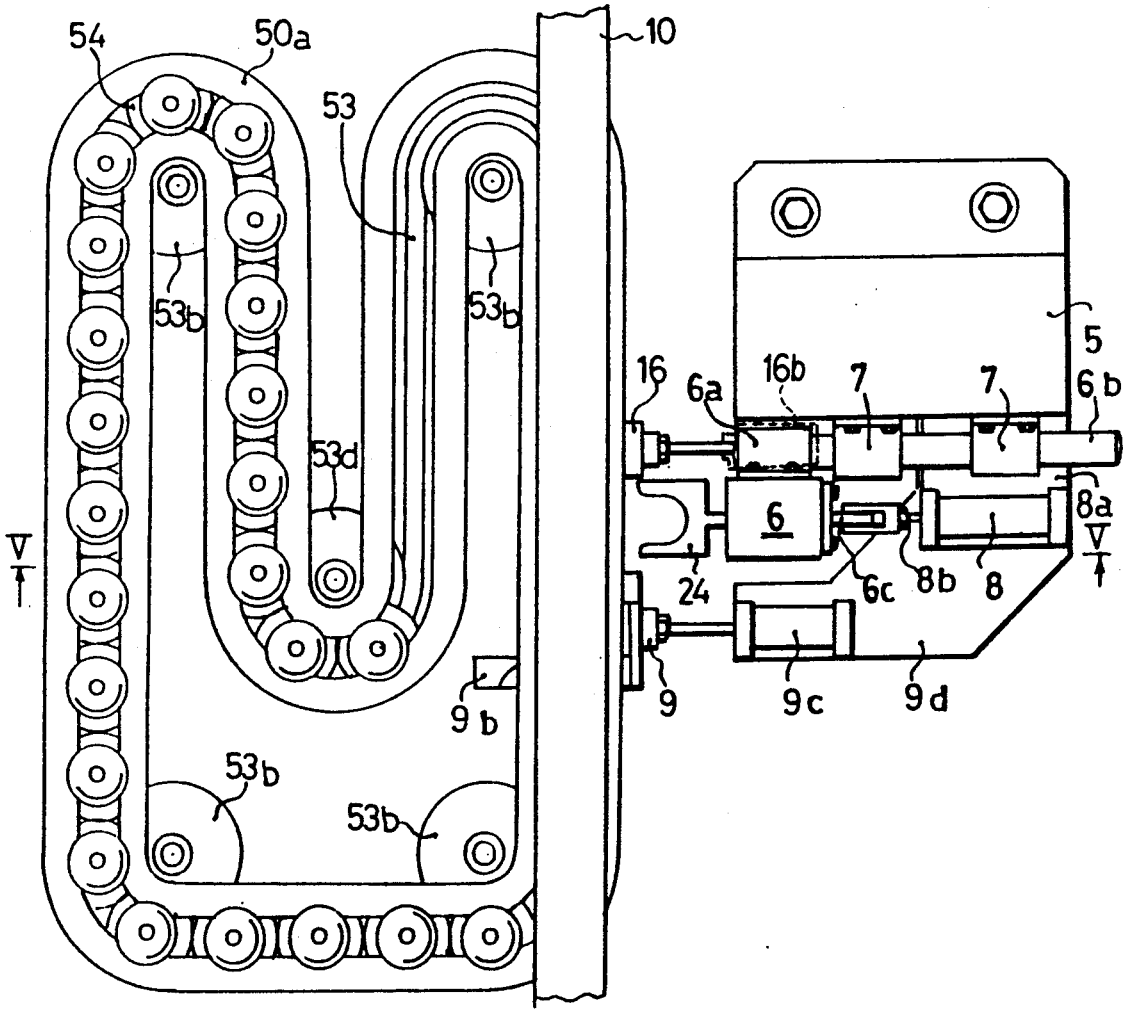
FIG. 6 is a partial enlarged view of FIG. 4.

FIG. 3 is a front elevational view for showing in an enlarged form the remained roving bobbin exchanging device 3 as viewed from its left side shown in FIG. 2. FIG. 4 shows a top plan view of FIG. 3. FIGS. 5 and 6 show enlarged part of FIGS. 3 and 4, and FIG. 5 is a view taken along a line V—V of FIG. 6. In these figures, a moving member 6 is formed by a box having some slits at the transporting line, in which the guiding shafts **6*b* and 6*b* are fixed at the upper part and the lower part of the side walls thereof through the brackets 6*a* and 6*a*. The guiding shafts 6*b* are freely supported at the supporting seats 7 and 7 fixed to a projecting wall 5, respectively. A supporting seat 6*c* is fixed substantially at a central part of a rear side of the moving member 6 and connected to a piston 8*b* of an operating cylinder 8. The operating cylinder 8 is fixed to the projecting wall 5 through the bracket 8*a*. Thus, the moving member 6 is moved toward the transporting rail 10 under operation of the operating cylinder 8. FIGS. 3 and 4 illustrate a waiting position where the moving member 6** is retracted.

In turn, as shown in FIG. 5, within this moving member 6 is stored an operating cylinder 34, in which a bobbin holding lever 24 is fixed to an extreme end of its piston **34*a* and as shown in FIG. 6, the bobbin holding lever 24 is formed at its extreme side a bobbin fitting concave part, and its plate-like lever is lifted up or descends along the aforesaid slits of the moving member 6. In FIG. 6, the operating medium pipes for the operating cylinders 8 and 34 and each of the operating cylinders to be described later are eliminated for their illustration. Flexible pipes or the like are connected through a compressor and a controller arranged in the projecting wall 5 or a block seat 5*a*. The operating cylinder 34 is constructed such that the bobbin holding lever 24 may occupy a waiting position indicated by a solid line and an ascending position indicated by a dotted line as well as a descending position indicated by an one-dotted-chain line in FIG. 5. It is recommended that when the bobbin holding lever is to be moved from the waiting position to the descending position or from the descending position to the waiting position, it is moved temporarily upward in particular. As the roving bobbin, one formed with a flange at its upper part is utilized and the bobbin is hung with the flange by the aforesaid fitting concave part of the holding lever 24**.

In turn, as shown in FIGS. 5 and 6, a tray transporting device 50 is constructed such that several bobbin inserting trays 54 are stored in the transporting line **50*a* formed in a closed loop. These trays 54 are moved only in one direction by a belt 53 having a circular section arranged to be circulated and moved within the transporting line 50*a*. This movement is carried out by the belt 53 so long as the trays 54 are not restricted to a certain degree. The tray transporting device 50 has its part arranged to be coincided with a location just below the bobbin transporting line 10, receives the remained roving bobbin la removed from the transporting line 10 in a vacant tray 54*a* and stores it temporarily, and forms a storing part for the vacant bobbins 1*b* to be newly fixed to the removed bobbin hangers. The belt 53 is tensioned at each of the turning corners of the tray transporting line 50*a* through pulleys 53*b*, 53*b* . . . and each of the pulleys receives a force of transmission from a driving device arranged in the block seat 5*a* and is rotated in such a manner as it may act as a positive driving pulley for a central pulley 53*d* in FIG. 6. The belt 53 is supported by the guide pulleys 53*b* arranged at proper locations of the transporting line 50*a*. It is already shown a case in which the remained roving bobbins in the tray transporting device 50 are removed from the trays and a manual insertion of the vacant bobbins is carried out. However, this transportation line 50*a* may be extended longer and the bobbin fixing or removal device may be formed in the midway of the transporting line or the bobbin exchanging device indicated by an one-dotted-chain line in FIG. 4 may be arranged along the transporting line 50*a***. As described later, if the setting device and the remained roving removal device are arranged together, it is possible to improve a productivity of the roving well.

In addition, this tray transporting device 50 is provided with a stopper 16 for stopping the trays 54 at their predetermined positions and a tray feeder 9 for releasing the tray while engaging the subsequent trays in such a way as they may hold the moving trace of the moving member 6 therebetween as shown in FIG. 6. These are operated by the operating cylinders **16*b* and 9*c* fixed to the projecting wall 5 through brackets, respectively. Reference numeral 9*b* denotes a bracket for the operating cylinder 9*c* and the bracket for the operating cylinder 16*b*** is not shown.

As partly shown in FIG. 5 (a partial enlarged view of FIG. 3), the transporting line 10 is provided with some bobbin hangers 12 having a group of pulleys arranged therein to be connected to each other in a guiding rail **10*a* formed with a slit at its lower side and every group or all of the hangers are moved together by a running device (not shown). The bobbin hanger 12 has a bobbin hanger lever 12*a* at its lower end side, its extreme end is provided with an opening or closing claw 12*b* so as to allow an entire rotation or a slight inclination of the hanger lever, thereby the bobbin is inserted into the hanger lever 12*a* and pushed it up to cause the opening or closing claw 12*b* to be opened and then the bobbin is supported by an enlarged step part formed in the bobbin clearance part. In case of removing the bobbin, the bobbin is pushed up again to cause the aforesaid opening or closing claw 12*b* to be enclosed in the hanger lever 12*a***, thereby the bobbin is released.

Figure 7:
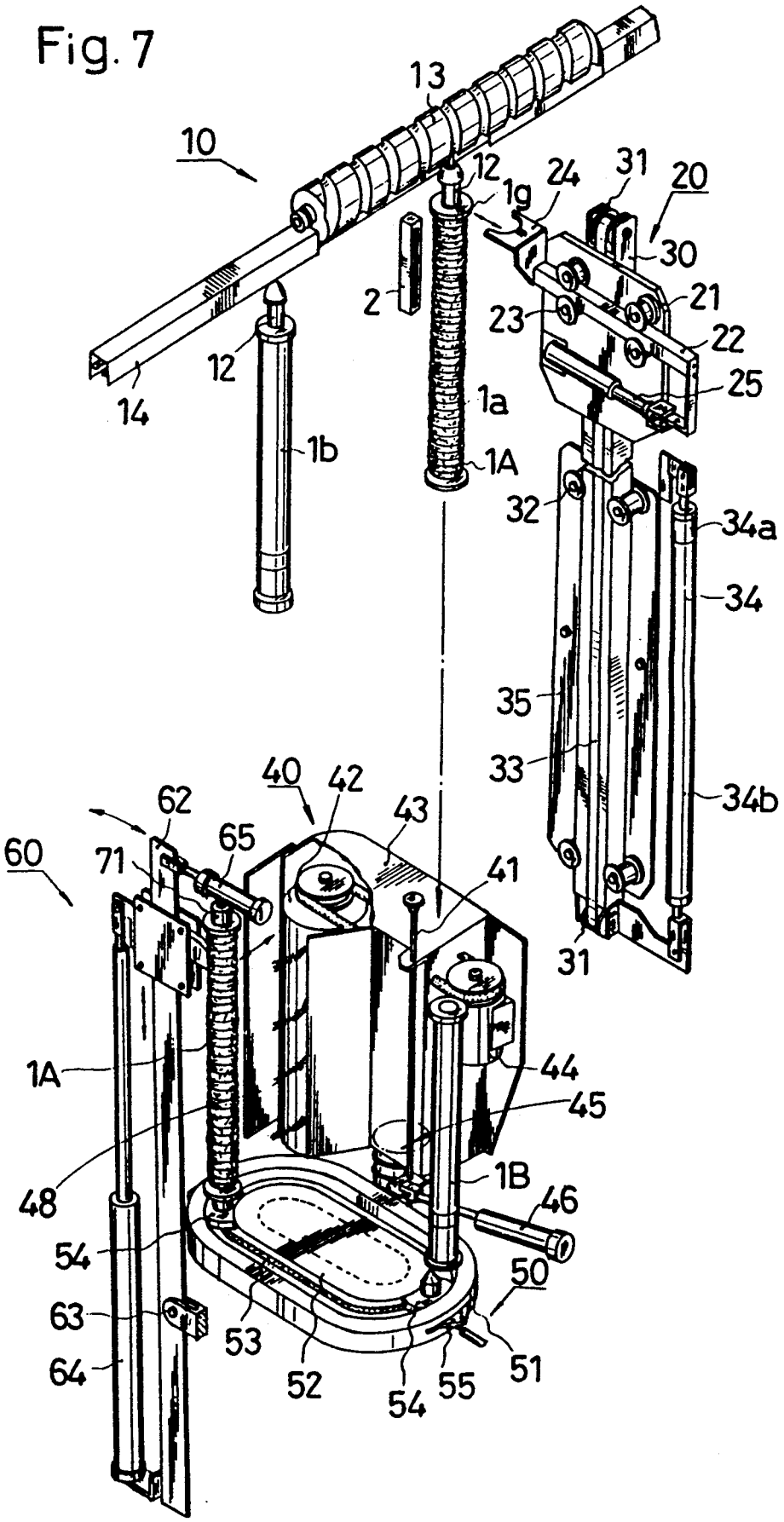
FIG. 7 is a perspective illustrative view for showing another preferred embodiment of the present invention.

FIG. 7 is a perspective illustration for showing a substantial part of another preferred embodiment of the roving bobbin processing device. The roving bobbin 1 is transported along the guide rail 14 of the transporting device 10 and changed over to the screw type transfer device 13 at its midway position. A lower part of the transfer device 13 is provided with a photo-electric (a color mark type) or a ultrasonic sensor 2 for use in detecting whether the remained rovings are adhered to the surface of the roving bobbin 1 and at the same time there is provided a fixing or removing device 20 opposing against the sensor 2 with the roving bobbin 1 held therebetween and removing the roving bobbin 1 from the bobbin hanger 12 or fixing it from the bobbin hanger 12. Below the fixing or removal device 20 is arranged a circulating storing device for storing the roving bobbins having the remained rovings adhered thereto and/or vacant bobbins. In addition, around a part of the circumference of the tray transporting device 50 are arranged a cutter device 60 for use in cutting the remained rovings in an axial direction of the bobbin and the removal device 40 for use in peeling off the remained rovings from the roving bobbins.

Referring now to FIG. 7, an operation for exchanging the roving bobbins having the remained rovings adhered thereto with the vacant bobbins will be described in sequence.

The roving bobbins 1 transported by the transfer device 10 are discriminated by the sensor 2 for a presence or a non-presence of adhering of the remained rovings. If it is judged that the remained rovings 1A are adhered to the bobbin, at least the screw type transfer device 13 is stopped and the roving bobbin 1*a* is removed from the bobbin hanger 12 by the fixing or removal device 20 and then the roving bobbin 1*a* is inserted onto the vacant tray 54 waiting at a specified position of the tray transporting device 50. Then, the tray 54 is displaced by a distance corresponding to one tray by the stopper 55 shown in FIG. 9 and the tray 54 having the vacant bobbin 1*b* inserted therein is moved to a specified position where the aforesaid roving bobbin is inserted, the vacant bobbin 1*b* is replaced on the aforesaid fixing or removal device 20, fixed to the bobbin hanger 12 with the roving bobbin 1*a* being removed previously and then the operation of the transfer device 13 is started again.

The roving bobbin 1*a* changed over to the tray transporting device 50 previously is moved to a specified position (i.e. a position restricted by the stopper 56) where the remained rovings are removed by the belt 53, the roving bobbin is rotatably supported by the supporting members 71 and 73 (See FIGS. 10 and 11) and the remained rovings adhered to the surface of the roving bobbin 1 are rapidly removed by the cutter device 60 and the removal device 40. Then, the completely vacant roving bobbin is circulated and fed to a side before the stopper 55 of the tray transporting device 50 and the bobbin is kept waited for a next or a subsequent next time exchanging of the roving bobbin. The number of vacant bobbins kept waited at the aforesaid tray transporting device 50 can be set to any number and it is sufficient to define it in correspondence with the frequency of occurrence of the roving bobbins having the remained rovings adhered thereto.

An example of a detailed structure of each of the fixing or removal device 20, the tray transporting device 50, the cutter device 60 and the removal device 40 will be described.

Figure 8:
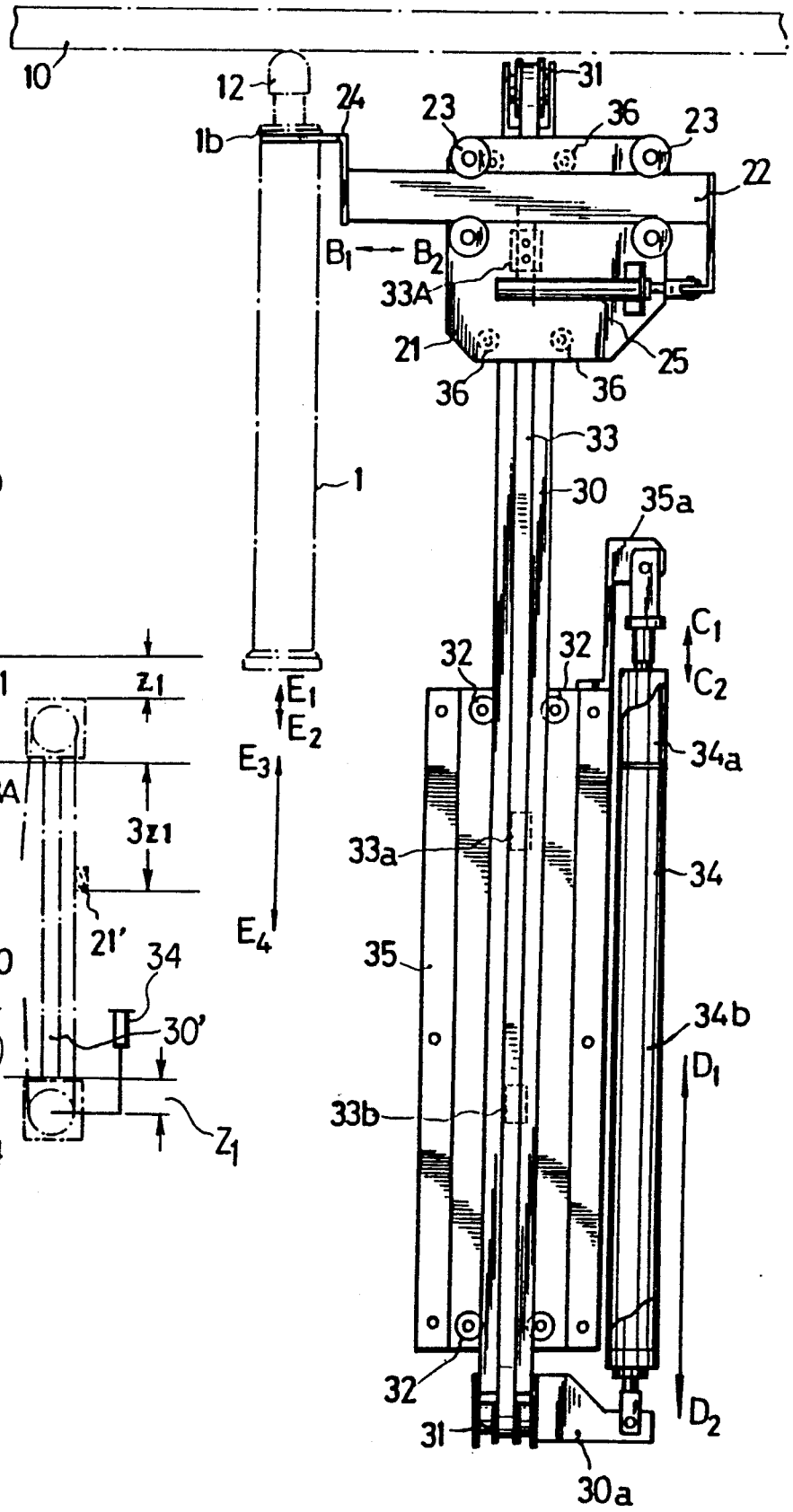
FIG. 8(*a*) is a side elevational view for showing an example of a fixing or removing device.
Figure 8:
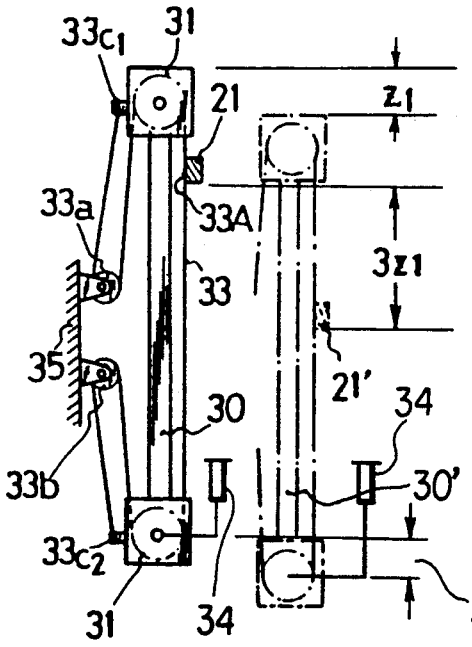

FIG. 8(*a*) is a side elevational view for showing the fixing or removal device 20, in which the fixing and removal device 20 comprises, as its major members, a vertical moving block table 21, an ascending or descending rod 30, a fixed block seat 35 and a cylinder 34.

The aforesaid fixed block seat 35 is fixed to a frame arranged on the roving bobbin processing device 3. To the fixed block seat 35 is connected the cylinder 34 through the bracket 35*a* and at the same time a pair of guide rollers 32 and 32 forming a pair of right and left rollers are arranged at the upper part and the lower part of the fixed block seat 35, and the ascending or descending rod 30 which can be moved up or down is inserted between the right and left guide rollers 32 and 32. A lower end of the ascending or descending rod 30 is connected to a sliding end of the cylinder 34 through a bracket 30*a*. The aforesaid cylinder 34 is formed into two stages of an upper cylinder 34*a* and a lower cylinder 34*b*, and then each of the cylinders 34*a* and 34*b* can be independently moved up and down. In turn, each of the guide rollers 31 and 31 is rotatably arranged at an upper end and a lower end of the ascending or descending rod 30, and a non-extendable belt 33 is applied in tension between the guide rollers 31 and 31. As shown in FIG. 8(*b*), the belt 33 is applied in tension through the rollers 33*a* and 33*b* fixed to the frame and their ends $33c_1$ and $33c_2$ are fixed to the ascending or descending rod 30, respectively. The movable block seat 21 which can be moved up and down is arranged at the ascending or descending rod 30 is arranged through the guide rollers 36 . . . , and the moving block seat 21 is connected to an intermediate part of the belt 33 by a fixing member 33A. The guide rollers 36 . . . are supported by the moving block seat 21, and the guide rollers 36 are constructed to be moved through their engagement with the ascending or descending rod 30. In addition, to the moving member 21 are fixed the guide rollers 23 and the cylinder 25. A horizontal rod 22 which can be moved in a horizontal direction is arranged between the guide rollers 23, one end of the horizontal rod 22 is connected to a sliding end of the cylinder 25 through a bracket and at the same time a fitting end 24 fitted just below a top flange part 1*g* at the roving bobbin 1 is connected to the other end of the horizontal rod 22. The fitting end 24 is formed with a semi-arcular recess coinciding with a circumferential surface of the roving bobbin 1 and its extreme end is formed with an extension so as to prevent the roving bobbin 1 held thereat from being dropped.

In case that the roving bobbin 1 hung at the transporting device 10 is removed by the fixing or removal device 20, the following operation will be carried out. At first, the ascending or descending block seat 21 is arranged at such a height as one corresponding to a part just below the upper flange of the roving bobbin 1, the cylinder 25 is retracted to cause the horizontal rod 22 to be advanced toward an arrow $B_1$ direction and then the fitting end 24 is fitted just below the flange 1*g* at the top end of the roving bobbin. The cylinder 34*a* is retracted to cause the ascending or descending block seat 21 to be slightly ascended toward an arrow $E_1$ and a bobbin engaging state at the bobbin hanger 12 is released. After this operation, the cylinders 34*a* and 34*b* are extended in the directions $C_2$ and $D_2$ so as to cause the ascending or descending rod 30 to be lowered. At this time, as the ascending or descending rod 30 is lowered by a distance of a stroke $z_1$, as shown in FIG. 8(*b*), the belt 33 is moved through the guide rollers 31 and rollers 33*a* and 33*b* by a distance twice the aforesaid stroke. A position of the ascending or descending moving body 21 is lowered by the belt 33 twice a descending stroke of the ascending or descending rod 30 ($2 \times z_1$), resulting in that the vertical moving block seat 21 descends in a stroke of three times in respect to an amount of extension of the cylinder 34 while supporting the roving bobbin 1. Then, the roving bobbin 1 is inserted into the tray 54 of the tray transporting device 50 to be described later, the bobbin is slightly lowered and at the same time the horizontal rod 22 is retracted in a horizontal direction (a direction indicated by an arrow $B_2$).

In case that the vacant roving bobbin 1*b* is fixed to the bobbin hanger 12, an operation is carried out in an order opposite to the above, the bobbin hanger 12 is changed over to its engaged state, hung and then the fitted end 24 is retracted in a horizontal direction.

Figure 9:
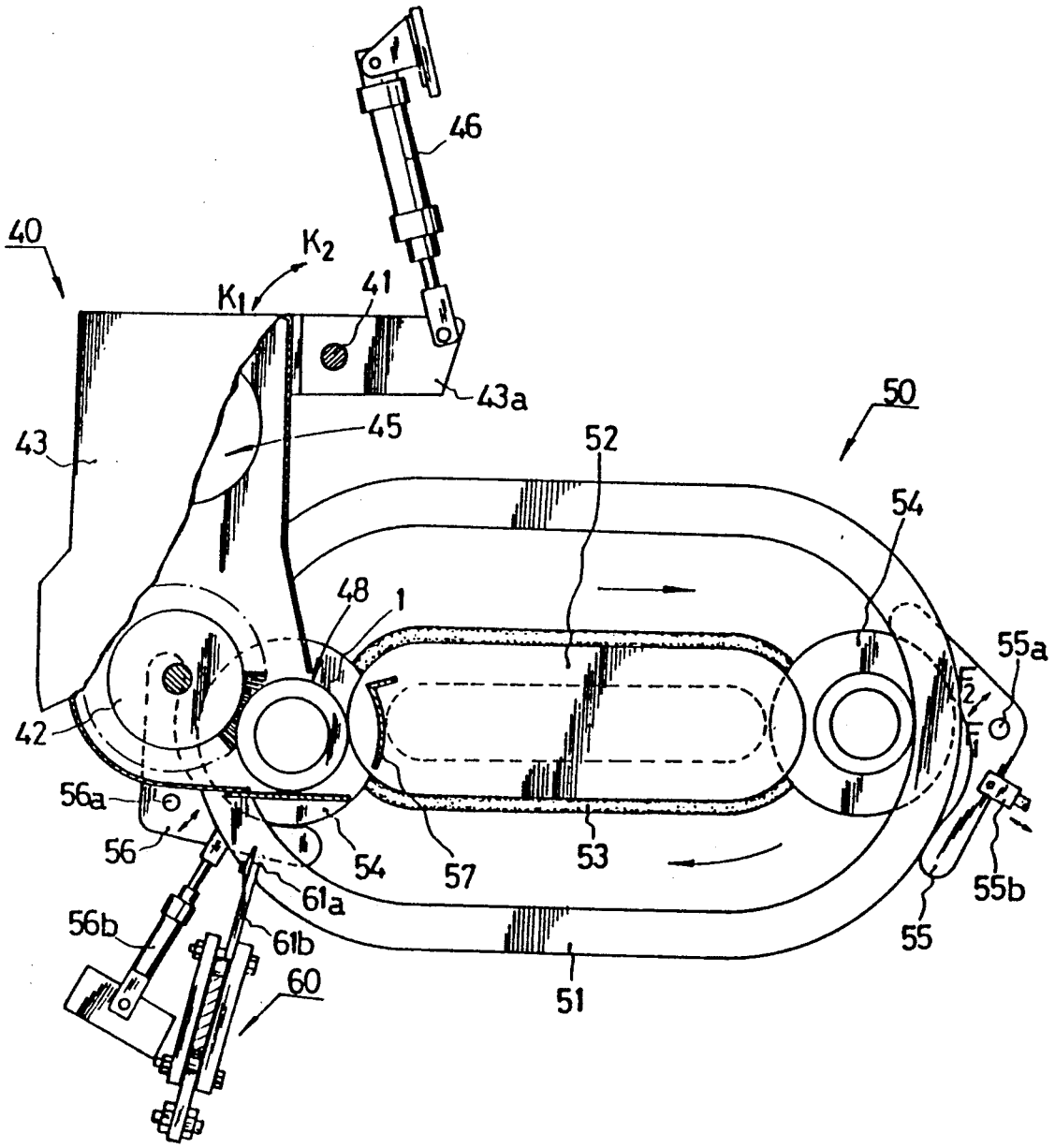
FIG. 9 is a top plan view for showing an example of a circulating storing device.
Figure 10:
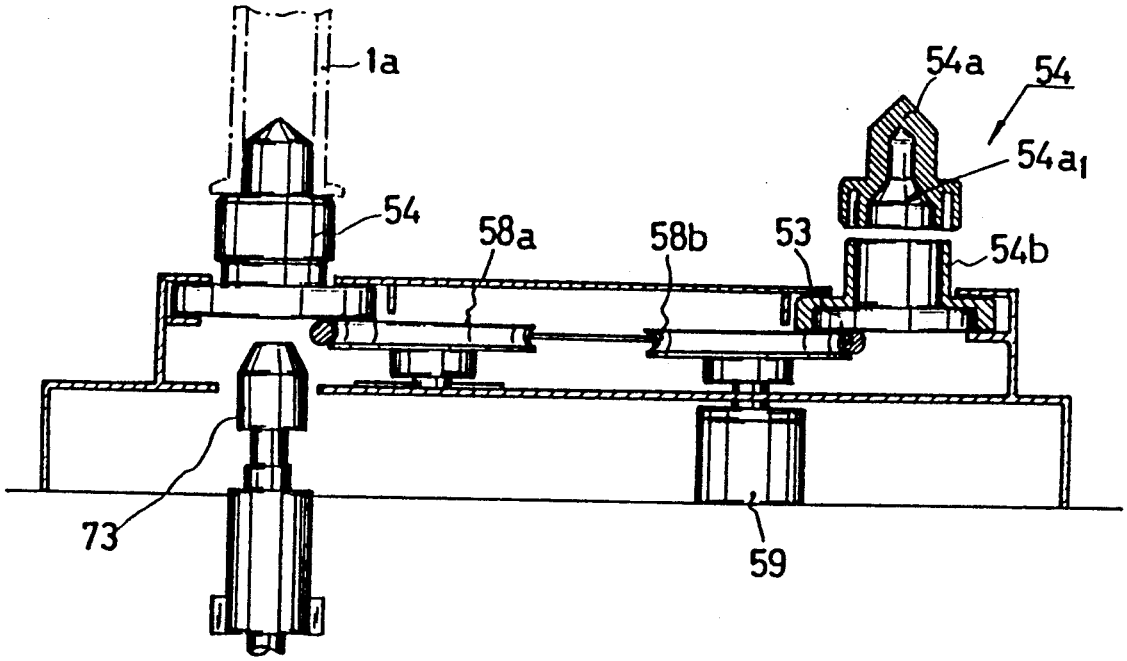
FIG. 10 is a partial side sectional view of FIG. 9.

FIG. 9 is a top plan view of the tray transporting device 50 and FIG. 10 is a partial side elevational view in section of FIG. 9. The tray transporting device 50 comprises an inner rail 52 and an outer rail 51 having a -shaped section. Outside the inner rail 52 is arranged a rotary belt 53 having a circular section tensioned between the pulleys 58*a* and 58*b*. Between the inner rail 52 and the outer rail 51 are fitted a proper number of trays 54 and the trays 54 are placed on the rotary belt 53 and can be circulated and moved toward the arrow direction. Outside the outer rail 51 are arranged position setting stoppers 55 and 56 of <-shape passing through the outer rail 51 and oscillated, the stopper 55 may restrict an inserting and pulling-out position of the roving bobbin at a specified position, in which the trays 54 can be engaged in compliance with the ascending or descending axis of the roving bobbin by the fixing or removal device 20. That is, the stopper 55 is pivotally supported by a pin 55*a*, the stopper 55 is oscillated toward arrows $F_1$–$F_2$, and the axis of the tray 54 can be coincided with the axis of the ascending or descending rod and engaged with it.

A stopper 56 is constructed in the same manner as that of the stopper 55 so as to cause the tray 54 to be engaged at a position where the remained rovings on the surface of the roving bobbin 1 are removed.

Reference numeral 59 denotes a driving source for driving the rotary belt 53. As shown in FIG. 10, the tray 54 is formed as a divided structure, a bottom part 54*b* and an upper bobbin inserting part 54*a* can be fitted to each other and the roving bobbin 1 can be positively held during the remained roving processing to be described later. In the aforesaid tray transporting device 50, the roving bobbin 1 removed by the fixing or removal device 20 is moved to the removal device 40 or the like to be described later while being inserted onto the tray 54 and at the same time the vacant bobbin having the remained rovings completely removed with the removal device 40 is delivered to the fixing or removal device 20.

Figure 11:
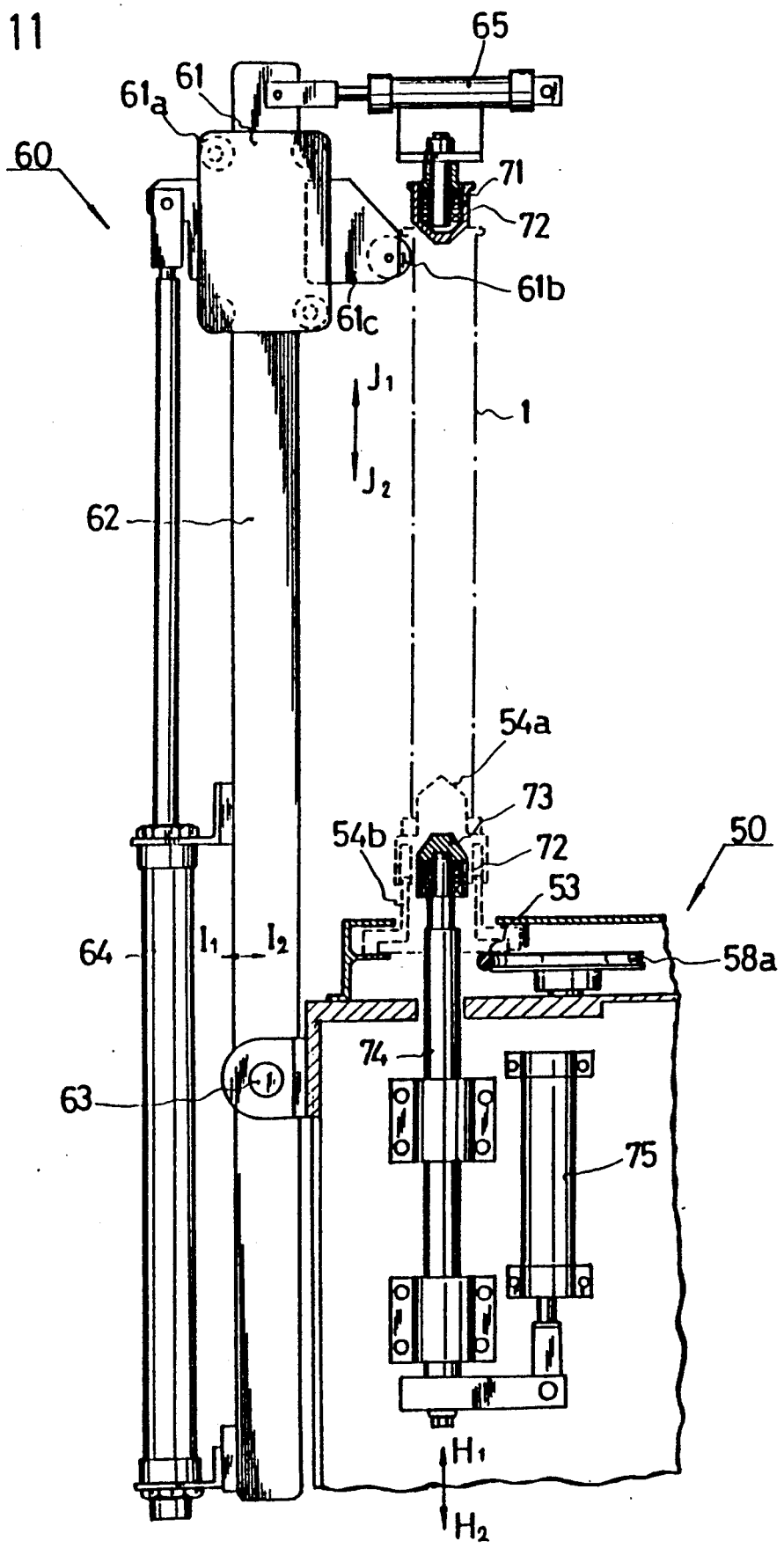
FIG. 11 is a partial side elevational view partly in section for showing a cutter device.

FIG. 11 is a side elevational view partly broken away for showing a part of the tray transporting device 50 and the cutter device 60. At the position just above the tray 54 engaged by the stopper 56, a supporting member 71 inserted into a hollow hole at the top end of the roving bobbin is fixed to the fixed frame and at the same time a sliding rod 74 which can be moved up and down is arranged just below the tray 54. A supporting member 73 which can be inserted into or taken out of an inner hole 54*a*$_1$ (See FIG. 10) of the bobbin inserting part 54*a* of the tray 54 is arranged at the top part of the sliding rod 74. The lower end of the sliding rod 74 is connected to the cylinder 75 through the bracket and can be moved up and down in the arrow directions $H_1$–$H_2$. Each of the supporting members 71 and 73 is supported through bearings 72 and 72, respectively and rotationally constructed.

That is, the roving bobbin 1 having the remained rovings adhered thereto is stopped by the stopper 56 at the remained roving removing position while being inserted into the tray 54, where the sliding rod 75 is lifted up, and then the roving bobbin 1 and the bobbin inserting part 54*a* are held between the supporting members 71 and 73 as indicated by a chain line.

The cutter device 60 which can be extended or retracted in respect to the holding position of the roving bobbin is placed adjacent to the aforesaid tray transporting device 50. The cutter device 60 includes a guide rail 62 which may be oscillated around a pivoting pin 63 and a cutter member 61 which can be moved up and down along the guide rail. To the upper end of the guide rail 62 is fixed the cylinder 65 so as to enable the guide rail 62 to be freely oscillated by the cylinder 65. To the guide rail 62 is fixed the cylinder 64 and then the sliding end of the cylinder 64 is fixed to the cutter member 61. The cutter member 61 may hold the guide rail 62 with two pairs of guide rollers 61*a* and further to the roving bobbin 1 of the cutter member 61 is fixed a cutting blade 61*b* through the cutter supporting member 61*c*.

Accordingly, after the roving bobbin 1 is supported between the supporting members 71 and 73, the cylinder 65 is retracted, the cutter blade 61*b* is approached to the surface of the roving bobbin, the cylinder 64 is retracted to cause the cutter blade 61*b* to be moved toward a center of the roving bobbin 1. The remained rovings adhered onto the surface of the roving bobbin 1 are cut open, the cylinder 65 is extended, and the entire guide rail 62 is retracted from the roving bobbin 1.

Referring now to FIGS. 7 and 9, the removal device 40 arranged adjacent to the aforesaid tray transporting device 50 will be described. The removal device 40 is made such that a rotary brush 42 and a suction duct 45 are formed in a cover 43. The cover 43 is supported by a rotary shaft 41 and connected to the cylinder 46 through an arm member 43*a*, rotatable in the arrow directions $K_1$–$K_2$ and further it may be moved to or away from the roving bobbin 1 which is rotatably supported by the supporting members 71 and 73. The cover 43 is formed with a vertical slit 48 and the roving bobbin 1 can be inserted inside the slit 48. At a back side of the slit 48 is arranged the rotary brush 42 rotated by the driving source 44 and further at the depth side of the rotary brush 42 is arranged the suction duct 45.

Accordingly, as the cylinder 46 is retracted and the cover 43 is moved in such a way as the roving bobbin 1 enters the slit 48, the remained rovings cut by the aforesaid cutter device 60 is peeled off by the rotary brush 42 and the peeled off remained rovings are collected into a remained roving collector not shown through the suction duct 45. At this time, the roving bobbin 1 is rotatably supported and rotated by the rotary brush 42, resulting in that the remained rovings adhered to the inner-most layer position on the roving bobbin are also positively removed. Reference numeral 57 denotes a dust-proof wall arranged at a position facing against the slit 48 with the roving bobbin 1 being held therebetween in order to prevent the remained roving peeled from the slit 48 from being splashed out of the device.

Figure 12:
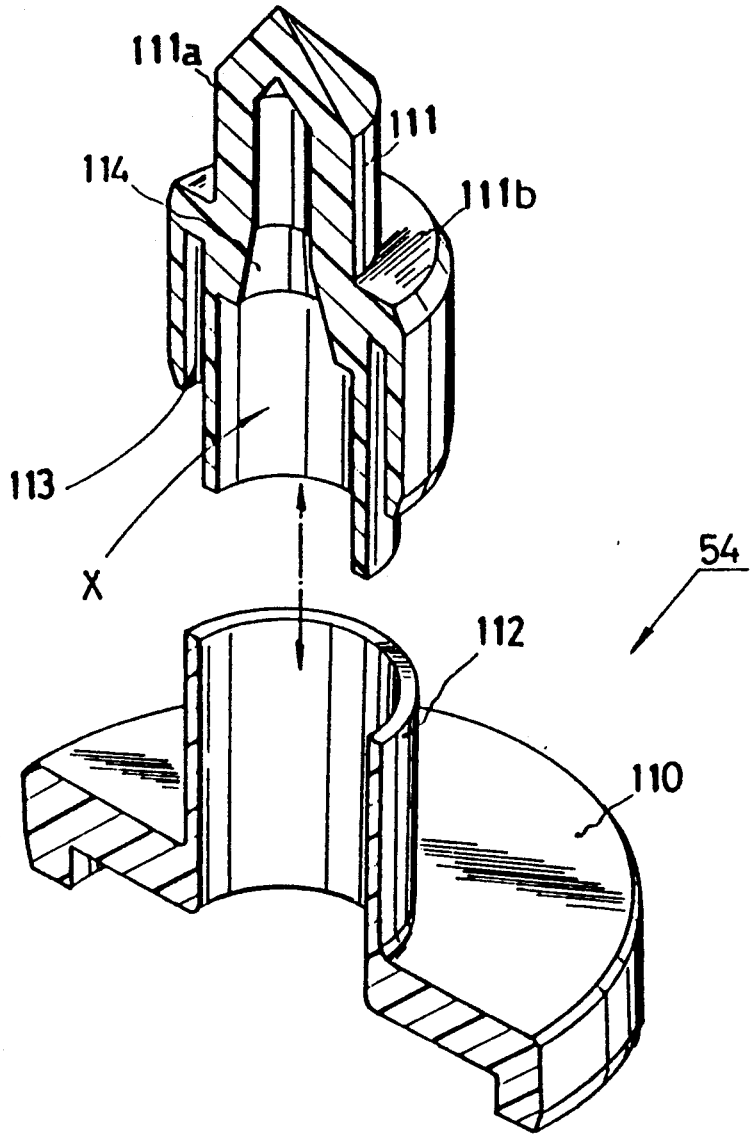
FIG. 12 is a perspective sectional view for showing a tray to be preferably used in a tray transporting device of the present invention.

FIG. 12 is a perspective view in section for showing a typical preferred embodiment of a transporting tray of the present invention. A seat 110 and a pin 111 are removably constructed and a hollow fitting projection 112 is integrally formed at a center of the seat 110 and at the same time a lower end of the pin 111 is formed with an annular groove 113 which can be fitted to the fitting projection 112. That is, the aforesaid fitting projection 112 is formed by a cylinder and it may be fitted to or removed from the annular groove 113. The pin 111 is formed with a pin 111*a* inserted into a bobbin hollow hole 103 and an abutting seat 111*b* for supporting a bottom surface of the bobbin at the lower end of the pin 111*a*. The roving bobbin 1 is vertically arranged under a state indicated by a chain line of FIG. 13 and transported along the transporting rails 141*a* and 141*b*. A hollow part is formed inside the pin 111, a part of the hollow part is formed with a supporting seat 114 to be described in detail. A removing member 130 is fitted to the supporting seat 114, the pin 111 is lifted up or down to perform a fitting or removal of the seat 110 thereagainst.

Figure 13:
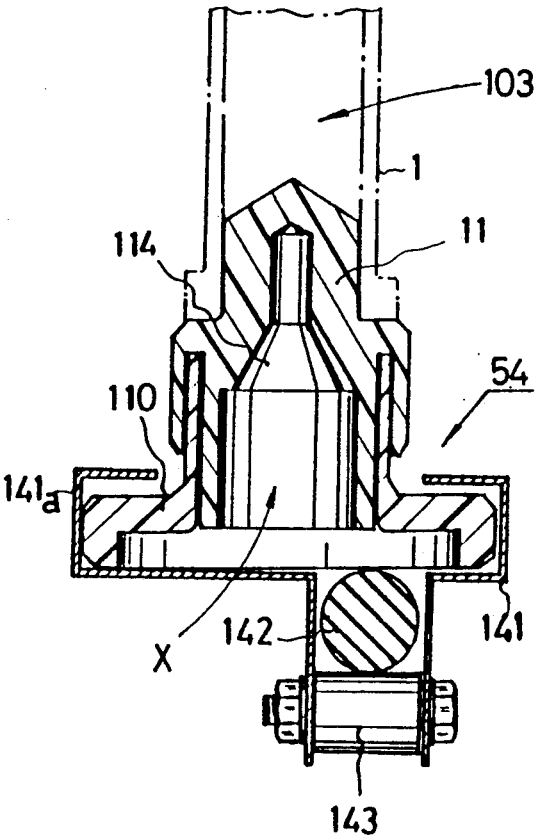
FIGS. 13 and 14 are sectional illustrative views for showing a state of use of the tray in FIG. 12.
Figure 14:
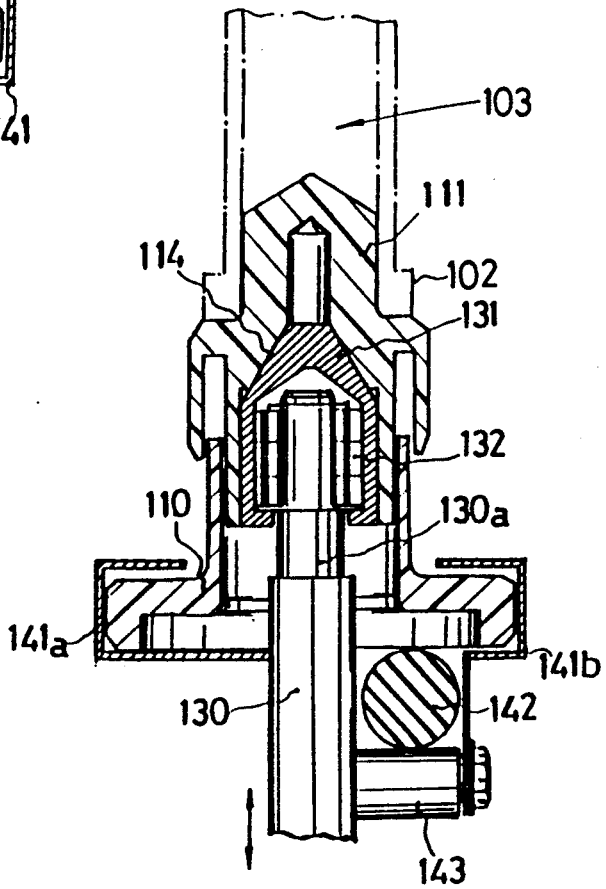
Figure 15:
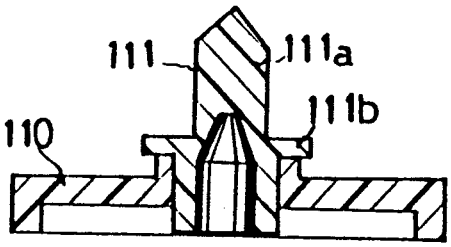
FIGS. 15 (*a*), (*b*) and (*c*) are sectional views for showing other preferred embodiments of the tray of the present invention.
Figure 15:
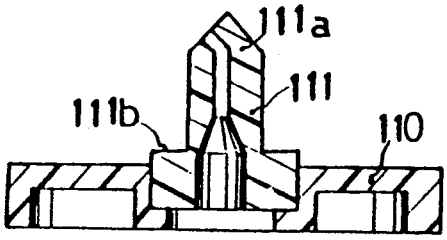
Figure 15:
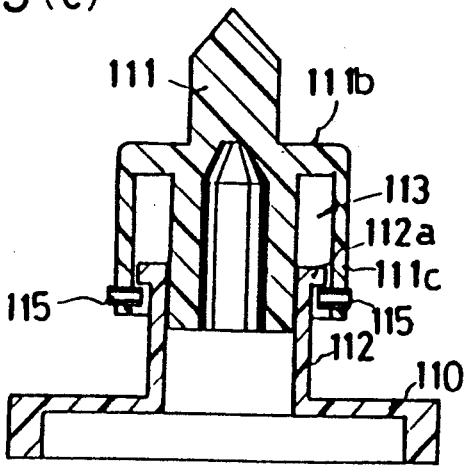

FIG. 13 is an illustrative view in section for showing a state in which the seat 110 and the pin 111 are fitted together. FIG. 14 is an illustration in section for showing a state in which the seat 110 and the pin 111 are spaced apart by the removing member 130. The removing member 130 is made such that the fitting member 131 is rotatably attached to the upper part of the ascending or descending rod 130*a* through a bearing 132. The transporting tray 54 transported by a conveyor belt 142 along the transporting rails 141*a* and 141*b* is stopped by a stopper or the like at a position where it is placed just above the removing member 130. The ascending or descending rod 130*a* is lifted up to cause the fitting member 131 to be fitted to the supporting seat 114 of the pin 111 and then the pin 111 and the roving bobbin 1 are repellently supported from the seat 110. Under this condition, a processing in which for example, the remained rovings adhered to the bobbin are removed by the aforesaid brush belt not shown or another processing in which the leading thread of the bobbin thread is pulled out are performed. At this time, the pin 111 and the roving bobbin 1 are supported by the removal member 130 having the bearing 132 installed therein and released from a contact with other members, resulting in that both members can be freely rotated so as to enable the aforesaid processings to be positively and easily performed. Upon completion of the processings, the ascending or descending rod 130*a* is lowered, the pin 111 is returned to the seat 110 through a fitting between the annular groove 113 and the fitting projection 112, resulting in that the transporting tray 54 and the bobbin 1 can be transported rapidly under a condition shown in FIG. 13. The fixing or removal structure of the seat 110 and the pin 111 are not limited to those illustrated in the drawings, but it is apparent that any fitting or removal structure shown in FIGS. 15(*a*) and (*b*) may also be applicable. As shown in FIG. 15(*c*) an outer extreme end of the projection 112 is formed with the flange part 112*a*, a lower part of the outer circumferential wall of the annular groove 113 is provided with a proper number of set screws 115 so as to prevent the pin 111 from being completely pulled out and it may keep its integral formation.

What is claimed is:

1. A device for exchanging a roving bobbin between a first position hanging from a transporting line and a second position on a tray in a tray transporting device provided beneath the transporting line, said device for exchanging a roving bobbin comprising:

a vertical moving block seat for removing a roving bobbin from said transporting line, said vertical moving block seat being attached to a movable belt;

a rod which can be moved up and down relative to a fixed frame, said rod having a guide roller rotatably mounted at each end thereof for receiving said belt, said belt passing around each of said guide rollers and said belt also passing around a plurality of fixed rollers rotatably mounted on said fixed frame; and at least one cylinder extending between an end of said rod and said fixed frame, said cylinder being expandable to move said rod and said belt relative to said fixed frame such that said vertical moving block seat is moved with a stroke of several times the length of a stroke of said at least one cylinder.

2. A device according to claim 1, further comprising:

a horizontal rod arranged on said vertical moving block seat so as to be movable in a horizontal direction, said horizontal rod having a first end connected to a sliding end of a horizontal actuating cylinder and a second end carrying a fitting end adapted to engage just below a top flange part of said roving bobbin.

3. A device according to claim 1, wherein:

said at least one cylinder includes a cylinder having a short stroke and a cylinder having a long stroke which are integral with each other in a vertical direction, and wherein the roving bobbin is removed from the transporting line through a vertical movement of the cylinder having a short stroke.

4. A device according to claim 1, wherein:

said tray transporting device includes a pair of spaced transporting rails, a driving belt arranged between the transporting rails, and a plurality of trays placed on the driving belt for vertically holding bobbins thereon and circulating and moving bobbins along the transporting rails.

5. A device according to claim 4, further comprising:

an eccentrically shaped pivotable stopper and a cylinder for oscillating said stopper to stop a tray at a predetermined position along said transporting rails, said stopper having two arms formed at an angle to one another and said stopper being pivotally supported at a position intermediate said arms.

6. A device according to claim 5, wherein said stopper is arranged so as to stop a tray in a position for receiving said roving bobbin from said vertical moving block seat, and wherein said tray supporting device further includes a vertically movable tray supporting member for holding the tray from below.

7. A device according to claim 4, wherein said tray transporting device is provided with a cutter device having a cutter blade controlled by an operating cylinder to cut open remained rovings adhered on the surface of the roving bobbins, and wherein a supporting member is provided for insertion into a hollow hole in the top part of the roving bobbins.

8. A device according to claim 7, wherein said tray transporting device is provided with a remained roving removal device including a rotary brush and a suction duct within a cover.

9. A device according to claim 4, wherein each of said trays has a seat and a pin rotatably and removably mountable on said seat, said seat being formed with a hole in a central part thereof and being movable along the transporting rails by said driving belt, and said pin being insertable into a hollow hole of a bobbin to hold the bobbin on the tray transporting device.

* * * * *